United States Patent [19]

Groetsch et al.

[11] Patent Number: 4,990,012

[45] Date of Patent: Feb. 5, 1991

[54] WRITING INSTRUMENT WITH DISPLACEABLE SAFETY SEPARATOR

[75] Inventors: Gerald Groetsch, Fürth; Ute Herold, Nünberg, both of Fed. Rep. of Germany

[73] Assignee: J.S. Staedtler GmbH & Co., Nuremberg, Fed. Rep. of Germany

[21] Appl. No.: 280,386

[22] Filed: Dec. 6, 1988

[30] Foreign Application Priority Data

Dec. 10, 1987 [DE] Fed. Rep. of Germany ..... 3741886

[51] Int. Cl.[5] ..... B43K 5/14

[52] U.S. Cl. ..... 401/134; 401/89; 401/132

[58] Field of Search ..... 401/132–135, 401/258–260; 222/83; 215/211, 213, 216, 255

[56] References Cited

U.S. PATENT DOCUMENTS

| | | | |
|---|---|---|---|
| 2,771,218 | 11/1956 | Henderson | 222/83 |
| 3,399,019 | 8/1968 | Koelichen | 401/134 |
| 3,404,811 | 10/1968 | Cernei | 222/83 |
| 4,271,982 | 1/1981 | Niksich et al. | 401/134 X |
| 4,757,916 | 7/1988 | Goncalves | 222/83 |
| 4,781,484 | 11/1988 | Goncalves | 401/132 |

FOREIGN PATENT DOCUMENTS

| | | | |
|---|---|---|---|
| 1561866 | 4/1970 | Fed. Rep. of Germany | 401/133 |
| 1105089 | 3/1968 | United Kingdom . | |

*Primary Examiner*—Richard J. Apley
*Assistant Examiner*—D. F. Crosby
*Attorney, Agent, or Firm*—Pascal & Associates

[57] ABSTRACT

In writing instruments having an ink or India ink reservoir, the reservoir should remain sealed prior to first use of the instrument. For this reason, the writing tip and the shaft containing the reservoir are delivered to the user separately. When the instrument is to be used for the first time, the writing tip is screwed into the shaft until the reservoir is pierced by the writing tip. The writing instrument of the invention enables delivery to the user in which the writing tip is already screwed into the shaft without piercing the reservoir. The writing tip has a removable separator piece which comes to rest at the front edge of the instrument shaft when the writing tip has been screwed in and thus limits the screw-in depth of the writing tip, the back end of the writing tip being maintained at a distance from the plug of the reservoir. After the separator piece has been torn off, the writing tip is completely screwed into the shaft whereby the back end of the writing tip pushes the plug into the reservoir.

5 Claims, 2 Drawing Sheets

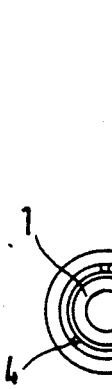
FIG. 8
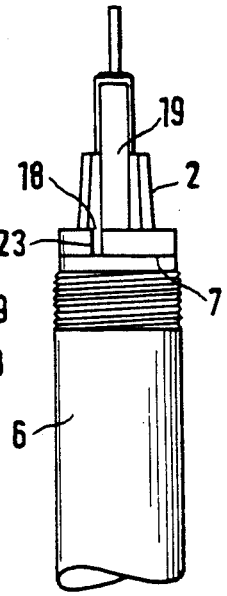
FIG. 9
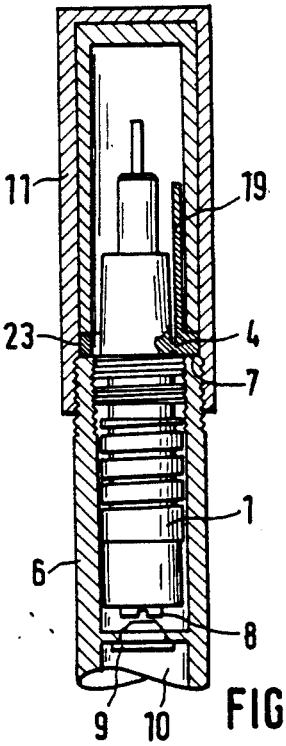
FIG. 10
FIG. 13
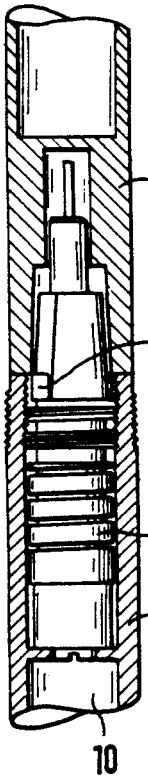
FIG. 12
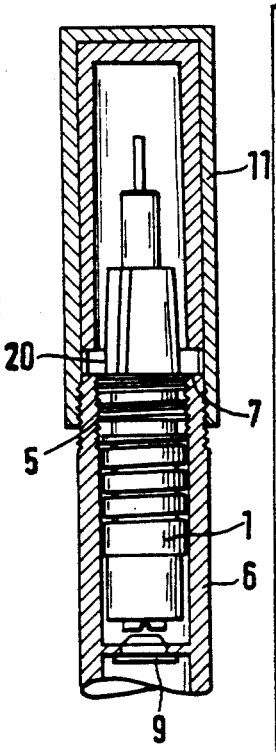
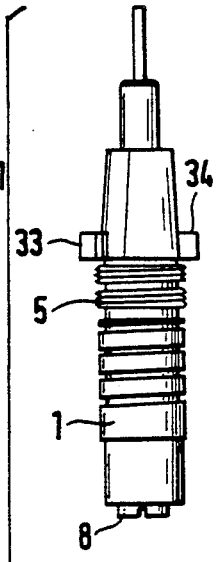
FIG. 11
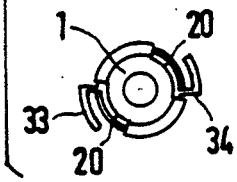
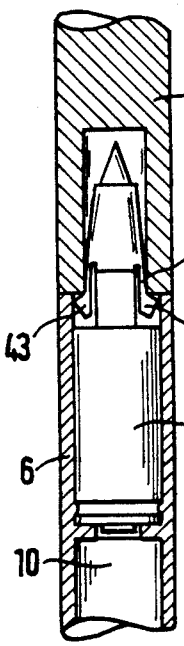
FIG. 15
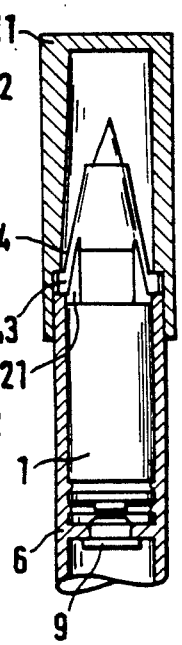
FIG. 14

WRITING INSTRUMENT WITH DISPLACEABLE SAFETY SEPARATOR

FIELD OF THE INVENTION

This invention relates to a writing instrument having a writing tip and associated fluid reservoir.

BACKGROUND OF THE INVENTION

In such writing instruments, an ink or India ink reservoir disposed therein is pierced by the back end of a writing tip when the writing tip is completely inserted into the instrument, in which, for example, a plug on the reservoir is pushed away by the writing tip. As a result, the writing instrument is rendered ready for writing. However, for delivery purposes of the instrument, the reservoir should be sealed. For this reason, these types of writing instruments are often delivered with the writing tip detached, and a cap is screwed onto the instrument. Prior to being used, the writing tip has to be screwed into the shaft of the instrument until the ink or India ink reservoir is pierced. A second possibility for delivery purposes is to not completely insert the writing tip into the instrument, so that the reservoir is not pierced by the writing tip. However, the cap of the writing instrument cannot be screwed on in this case, since the writing tip could turn further into the shaft which would lead to the reservoir being pierced.

DESCRIPTION OF THE PRIOR ART

In order to make it possible to deliver the writing instrument in a compact form, a separator piece can be provided as disclosed in British Patent No. 11 05 089. With this structure, the instrument is comprised of a back part for receiving the reservoir and a front part for receiving the writing tip, between which a ring-shaped separator piece, provided with a tear-off flap, is disposed for delivery. The two parts of the apparatus are screwed together. If the separator piece is torn off, then it is possible to screw the two parts together further, whereby the back end of the writing tip then pierces the reservoir.

The disadvantage of this known writing instrument is that the apparatus consists of two parts and that these two parts have to be screwed together.

SUMMARY OF THE INVENTION

It is an object of the present invention to improve the writing instrument in such a way that the writing tip has two defined, different steps for assembly, one for the delivery and the other for the actual use.

The preferred embodiment of the present invention is a writing instrument having a writing tip inserted therein and a fluid reservoir for ink or India ink disposed therein. A separator piece separating the back end of the writing tip a distance from the front end of the reservoir is retained on a shoulder, and permits the back end of the writing tip to come into contact with the front end of the reservoir after removal of the separator from the shoulder. This enables the reservoir to be opened. The shoulder forms a front edge of the writing instrument shaft. The separator piece is connected to the writing tip and, when placed against the shaft edge, limits the depth of insertion of the writing tip into the shaft so that the back end of the writing tip and the front end of the reservoir are spaced from one another with the shaft.

BRIEF INTRODUCTION TO THE DRAWINGS

Embodiments of the invention will be described in greater detail below, with reference to the following drawings, in which:

FIG. 8 is a top view of a writing tip according to a fourth embodiment;

FIG. 9 is a side view of the shaft and the writing tip of the fourth embodiment, as delivered;

FIG. 10 is a section of the kind shown in FIG. 2 of the fourth embodiment, as delivered;

FIG. 11 is a side view and top view and a writing tip according to a fifth embodiment;

FIG. 12 is a section of the kind shown in FIG. 2 in a fifth embodiment, as delivered;

FIG. 13 is a section corresponding to FIG. 12 when the writing tip has been completely inserted into the instrument;

FIG. 14 is a section corresponding to FIG. 2 in a last embodiment, as delivered, and FIG. 15 is a section corresponding to FIG. 14 when the writing tip has been completely inserted into the device.

DESCRIPTION OF THE INVENTION

Figure 1:
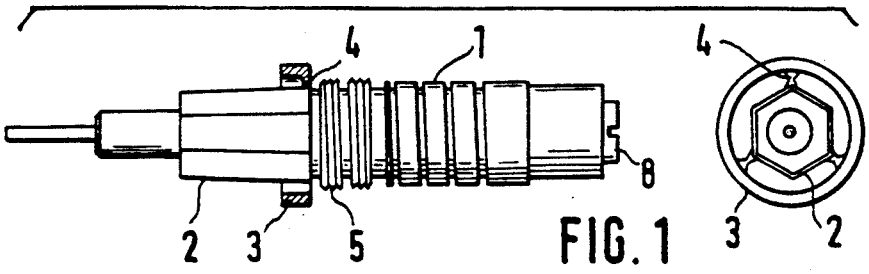
FIG. 1 is a side view and top view of a writing tip according to a first embodiment.
Figure 2:
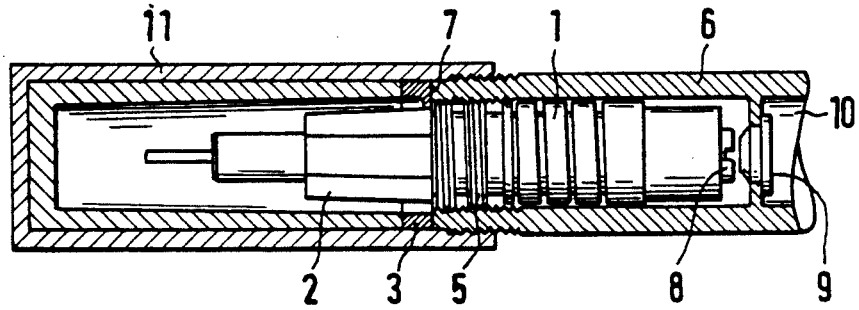
FIG. 2 is a section through the head of a writing instrument in the first embodiment, as delivered.
Figure 3:
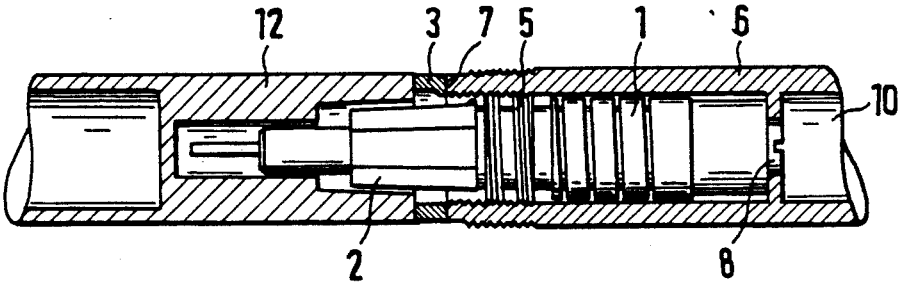
FIG. 3 is a section corresponding to FIG. 2 when the writing tip has been completely inserted into the instrument.

According to the embodiment shown in FIGS. 1 to 3, the instrument writing tip 1 has a separator piece 3 at the back end of its screw-in hexagon 2 shaped cross-section portion, the separator piece 3 being connected with the screw-in hexagon 2 via flanges 4 designed as preset breaking points. The thread 5 of the writing tip 1 adjoins the separator piece 3.

For delivery, the writing tip 1 is threaded into the shaft 6 until the separator piece 3 comes to rest at the front edge 7 of the shaft 6.

The back end 8 of the writing tip 1 is thereby spaced from the plug 9 of the ink or India ink reservoir 10 of the shaft 6. In this state for delivery of the instrument, a protective cap 11 can be screwed onto the shaft 6 as usual.

To make the instrument usable, the writing tip 1 is turned further into the shaft 6 by means of a hexagonal key 12 fitted to the screw-in hexagon 2, until the back end 8 of writing tip 1 pushes plug 9 into the reservoir. As a result, the writing tip 1 is supplied with ink or India ink from the reservoir 10. When the tip 1 is screwed further into the shaft 6, the flanges 4 are broken off so that the separator piece 3 is separated from the instrument tip 1. After the key 12 has been removed, the separator piece 3 slides off the tip and is discarded. The writing instrument is now ready for use and, when not in use, can be sealed by screwing the protective cap 11 on.

Figure 4:
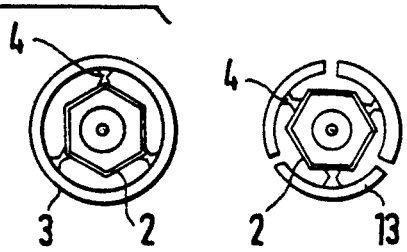
FIG. 4 is a top view onto a writing tip according to a second embodiment.

The shape of the separator piece 3 can be a closed ring as shown in FIG. 1. However in place of a closed ring, the separator piece can be comprised of circular segments 13, which are each connected to the writing tip 1 via a flange 4, as shown in FIG. 4. The circular segments 13 are otherwise disposed on the writing tip 1 in a manner corresponding to the closed ring shown in FIG. 1.

Each of the separator pieces 3 or 13, therefore, limits the screw-in depth of the writing tip 1 into the shaft 6 in such a way that the back end 8 of the writing tip does not come in contact with the front end of the reservoir, formed by the plug 9.

Figure 5:
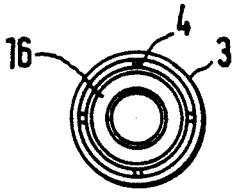
FIG. 5 is a top view of a writing tip according to a third embodiment.
Figure 6:
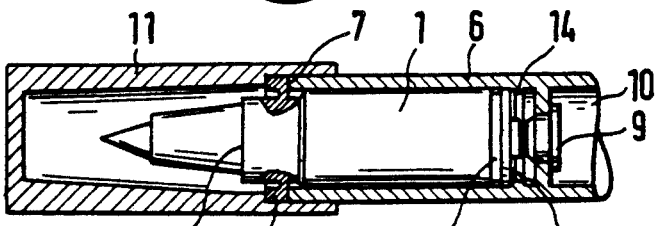
FIG. 6 is a section of the kind shown in FIG. 2 of the third embodiment, as delivered.
Figure 7:
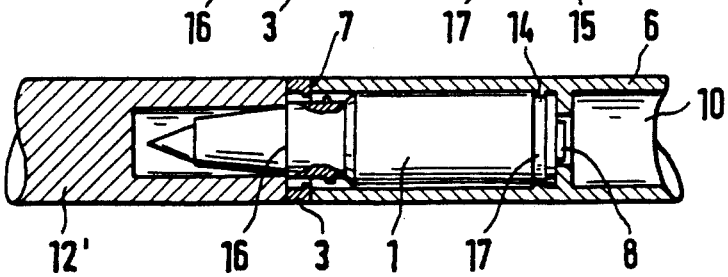
FIG. 7 is a section of FIG. 6 when the writing tip has been completely inserted into the instrument.

In the embodiment shown in FIGS. 5 to 7, the writing tip 1 cannot be screwed into the shaft 6 but can be inserted. The writing tip 1 also has a separator ring 3 which is connected to the tip 1 via flanges 4 which serve as preset breaking points. For delivery, the ring 3 lies against the front edge 7 of the shaft 6. In this case, the back end 8 of the writing tip 1 is maintained at a distance from the plug 9 of the reservoir 10. For additional security, a circular protrusion 14 is provided inside the shaft 6 directly in front of the plug 9, the back edge 15 of the writing tip 1 coming to rest against the circular protrusion 14. For delivery, the cap 11 is placed on shaft 6.

The writing tip 1 has a shoulder 16 between the separator piece 3 and its front end. If a tool 12' is attached to this shoulder 16 and the writing tip 1 inserted further into the shaft 6 with it, then the separator piece 3 is separated from the writing tip 1 because the flanges 4 break. At the same time, the circular protrusion 14 comes to rest in a circular groove 17 which extends along the back edge 15 of the writing tip 1. The position for use of the writing tip 1 is thus secured in the shaft 6. When tip 1 is pushed in by means of tool 12', the plug is pushed into the reservoir 10 by the back end 8 of the writing tip 1.

In this embodiment, the circular protrusion 14 serves, on the one hand, as additional security for the writing tip 1 when being delivered and, on the other hand, to secure the position for use of this tip 1 in the shaft 6.

In the embodiment according to FIGS. 8 to 10, the writing tip 1 has a split separator ring 23 which is connected to the writing tip 1 via flanges 4 serving as preset breaking points in front of the screw-in thread 5. In the area of a slot 18, a tear-off flap 19 is formed on the separator ring 23, which extends with its free end in a direction toward the front end of the writing tip 1. For delivery, the writing tip 1 is screwed so far onto the shaft 6 until the separator ring 23 comes to rest at the front edge 7 of the shaft 6. For delivery, the writing instrument is sealed by screwing the cap 11 onto shaft 6.

When the instrument is intended to be used, the separator piece 23 is removed from the writing tip 1 by pulling on the tear-off flap 19 and the writing tip 1 is then screwed into shaft 6 to its maximum screw-in depth.

In a fifth embodiment according to FIGS. 11 to 13, the writing tip 1 has circular segmental separator pieces 33 which are each connected to the back end of the screw-in hexagon 2 of writing tip 1 via thin, film hinge-like flanges 34. As described in connection with FIGS. 1 to 3, for delivery, the tip 1 is screwed so far into the shaft 6 until the separator pieces 33 come to rest at the front edges 7 of the shaft 6. For delivery, the writing tip 1 is protected by the cap 11 screwed onto shaft 6. To make the instrument ready for use, the writing tip 1 is screwed further into shaft 6 by means of tool 12, whereby the ring segmental separator pieces 33 are pushed inward while flanges 34 become deformed and are pulled into the shaft 6 together with the tip. For this purpose, tip 1 can, in the area of the separator pieces 33, have ring segmental recesses 20 in which the separator pieces 33 come to rest.

In the embodiment according to FIGS. 14 and 15, two ring segmental separator pieces 43 are provided, which are each connected to tip 1 via an axially extending, flexible flange 44. The flange 44 extends from the separator pieces 43 in direction of the front end of tip 1. Recesses 21 are provided at the tip 1 in the area of separator pieces 43.

For delivery, the writing tip 1 is inserted so far into shaft 6 until the separator pieces 43 come to rest at the front edge 7 of shaft 6. For delivery purposes, the writing tip 1 is protected by cap 11 which has been placed on shaft 6.

If the flanges 44, which are flexible and extend at an acute angle to one another, are pressed inward by a tool 12, then these flanges and the separator pieces 43 are received by recesses 21, so that the writing tip 1 can now be completely inserted into shaft 6. In this insertion, the front edge of the bore of tool 12 lies adjacent to the front shoulders of separator pieces 43. In addition, fixing the position for delivery and use takes place as described with reference to the embodiment of FIGS. 6 and 7.

We claim:

1. A writing instrument having a writing tip inserted therein and a fluid reservoir for ink or India ink disposed therein, a separator piece separating the back end of the writing tip a distance from the front end of the reservoir retained on a shoulder and permitting the back end of the writing tip to come into contact with the first end of the reservoir after removal of the separator from the shoulder, thus enabling the reservoir to come into contact with the front end of the reservoir after displacement of the separator from the shoulder thus enabling the reservoir to be opened, the shoulder forming a front edge of the writing instrument shaft, the separator piece being flexibly connected to the writing tip, the separator piece when placed against the shaft edge limiting the depth of insertion of the writing tip into the shaft so that the back end of the writing tip and the front end of the reservoir are spaced from one another within the shaft, the separator piece being inwardly flexed toward the writing tip so as to be retained within the shaft upon compressing the separator piece while forcing the writing tip into the shaft, thus causing displacement of the separator piece and subsequent movement of the back end of the writing tip into adjacency to the reservoir.

2. A writing instrument according to claim 1, in which the parts of the separator piece are ring segments which are connected to the writing tip via one radial film hinge each.

3. A writing instrument according to claim 1, in which the parts of the separator piece are ring segments which are connected to the writing tip via one axially extending, flexible flange each.

4. A writing instruction according to one of claims 1 or 3, in which the writing tip contains recesses for receiving the parts of the separator piece.

5. A writing instrument according to one of claims 1, 2, or 3 are including an inner ring-shaped protrusion of the shaft against which the back end of the writing tip comes to rest for limiting the depth of insertion of the writing tip into the shaft, the writing tip having a groove adjacent its back end for engagement with the protrusion when the writing tip is completely inserted into the shaft.

* * * * *